US007802382B2

(12) United States Patent
Eades et al.

(10) Patent No.: US 7,802,382 B2
(45) Date of Patent: Sep. 28, 2010

(54) NOVELTY FOOTWEAR ITEM AND METHOD OF USING SAME

(75) Inventors: John Michael Eades, San Diego, CA (US); Michael Gass, Encinitas, CA (US); Joel Steven Barrie, Cardiff, CA (US)

(73) Assignee: South Cone, Inc.

( * ) Notice: Subject to any disclaimer, the term of this patent is extended or adjusted under 35 U.S.C. 154(b) by 723 days.

(21) Appl. No.: 11/811,217

(22) Filed: Jun. 8, 2007

(65) Prior Publication Data

US 2008/0110057 A1 May 15, 2008

Related U.S. Application Data

(63) Continuation-in-part of application No. 11/595,095, filed on Nov. 11, 2006, now abandoned.

(51) Int. Cl.
*A43B 23/00* (2006.01)
*A43B 3/12* (2006.01)
*A43B 13/14* (2006.01)

(52) U.S. Cl. ..... 36/136; 36/11.5; 36/1

(58) Field of Classification Search ..... 36/136, 36/11.5, 1, 30 R, 132
See application file for complete search history.

(56) References Cited

U.S. PATENT DOCUMENTS

| | | | | |
|---|---|---|---|---|
| 32,490 | A | 6/1861 | Towers | |
| 537,492 | A | 4/1895 | Smith | |
| 921,433 | A | 5/1909 | Miller | |
| 922,499 | A | 5/1909 | Molitor | |
| 1,030,085 | A | 6/1912 | Hale | |
| 1,085,254 | A | 1/1914 | Halley | |
| 1,736,827 | A | 11/1929 | Johnson | |
| 1,907,995 | A | 5/1933 | Nickerson | |
| 2,037,970 | A | 4/1936 | Everston | |
| 2,070,814 | A | 2/1937 | Stemmons | |
| 2,208,330 | A | 7/1940 | Oakley | |
| 2,478,411 | A | 8/1949 | Martin | |
| 2,507,991 | A | 5/1950 | Neal | |
| 2,599,740 | A | 6/1952 | Beveridge | |
| 2,897,609 | A | 8/1959 | Bodkin | |
| 2,904,901 | A | 9/1959 | Goldstein | |
| 3,328,900 | A | 7/1967 | Weitzner | |
| 3,800,133 | A * | 3/1974 | Duval | 36/137 |
| 4,845,863 | A | 7/1989 | Yung-Mao | |
| 5,231,776 | A | 8/1993 | Wagner | |
| 5,285,586 | A | 2/1994 | Goldston et al. | |
| 5,438,768 | A | 8/1995 | Bauerfeind | |

(Continued)

*Primary Examiner*—Ted Kavanaugh
(74) *Attorney, Agent, or Firm*—Jerry R. Potts

(57) ABSTRACT

A novelty footwear item includes a flexible outsole, a flexible footbed and a flexible elongated wedge-shape midsole. The midsole has a unitary construction including a heel support area and an arch support area. An open storage compartment is disposed within the heel support area and is concealed by the footbed which overlays the midsole and the outsole. The footbed is fixedly attached to a front toe area of the outsole and fixedly attached to the midsole at about the arch support area. The footbed is further removably attached to the midsole at about the heel support area so that the footbed may be lifted up pivotally and way from the heel support area to provide user access to the storage compartment. Stiffeners disposed within the footbed facilitate the pivoting of the footbed and prevent collapse of the footbed into the compartment under a user load.

21 Claims, 5 Drawing Sheets

U.S. PATENT DOCUMENTS

| | | | | |
|---|---|---|---|---|
| 5,644,858 | A | 7/1997 | Bemis | |
| 5,692,324 | A | 12/1997 | Goldston et al. | |
| 5,921,008 | A | 7/1999 | Ruff | |
| 6,000,147 | A | 12/1999 | Kellerman | |
| 6,094,844 | A | 8/2000 | Potts | |
| 6,195,920 | B1 | 3/2001 | Morris et al. | |
| 6,243,974 | B1 | 6/2001 | Schaj | |
| 6,453,578 | B1 | 9/2002 | Yung et al. | |
| 6,898,875 | B2 | 5/2005 | Ruff | |
| 7,028,422 | B1 * | 4/2006 | Lewis | 36/136 |
| 7,174,657 | B2 * | 2/2007 | Berg et al. | 36/11.5 |
| 7,418,793 | B2 * | 9/2008 | Dominguez et al. | 36/136 |
| 2007/0193064 | A1 * | 8/2007 | Xu | 36/25 R |

* cited by examiner

NOVELTY FOOTWEAR ITEM AND METHOD OF USING SAME

RELATED APPLICATIONS

This is a continuation-in-part utility patent application of a U.S. patent application Ser. No. 11/595,095 entitled "Novelty Footwear Item With Stash", filed on Nov. 11, 2006 now abandoned, and is related to U.S. patent application Ser. No. 11/811,216 entitled "Novelty Footwear Item With Storage Chest and Method of Using Same" by Nicholas Mann et al., filed on Jun. 8, 2007, each of the above-mentioned patent applications being assigned to a common owner, South Cone, Inc.

BACKGROUND OF THE INVENTION

This invention relates generally to a novelty footwear item and method of using the footwear for concealed personal writing items. More particularly the novelty footwear construction of the present invention includes a liftable midsole that provides user access to a stash compartment for holding a pen and paper pad that can be utilized immediately by the user upon retrieval from its concealed compartment.

PRIOR ART

When one is carrying on his or her daily business or just relaxing, whether at the beach, park or other places of outdoor relaxation and entertainment, it may be necessary to have immediate access to pen and paper for writing down important information, such as a telephone number, a fax number, an e-mail address or the like. Therefore, it would be highly desirable to have a new and improved novelty footwear item that permits a user to carry pen and paper in a concealed manner within the footwear while further providing the user with a unique utility storage compartment for other small items such as credit cards, coins, and paper money, for example.

SUMMARY OF THE INVENTION

A novelty footwear item includes a flexible outsole, a flexible footbed and a flexible elongated wedge-shape midsole. The midsole has a unitary construction including a heel support area and an arch support area. An open storage compartment is disposed within the heel support area and is concealed by the footbed which overlays the midsole and the outsole. The footbed is fixedly attached to a front toe area of the outsole and fixedly attached to the midsole at about the arch support area. The footbed is further removably attached to the midsole at about the heel support area so that the footbed may be lifted up pivotally and way from the heel support area to provide user access to the storage compartment. Stiffeners disposed within the footbed facilitate the pivoting of the footbed and prevent collapse of the footbed into the compartment under a user load.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings wherein.

DETAILED DESCRIPTION OF THE PREFERRED EMBODIMENTS OF THE INVENTION

Figures 1, 2:
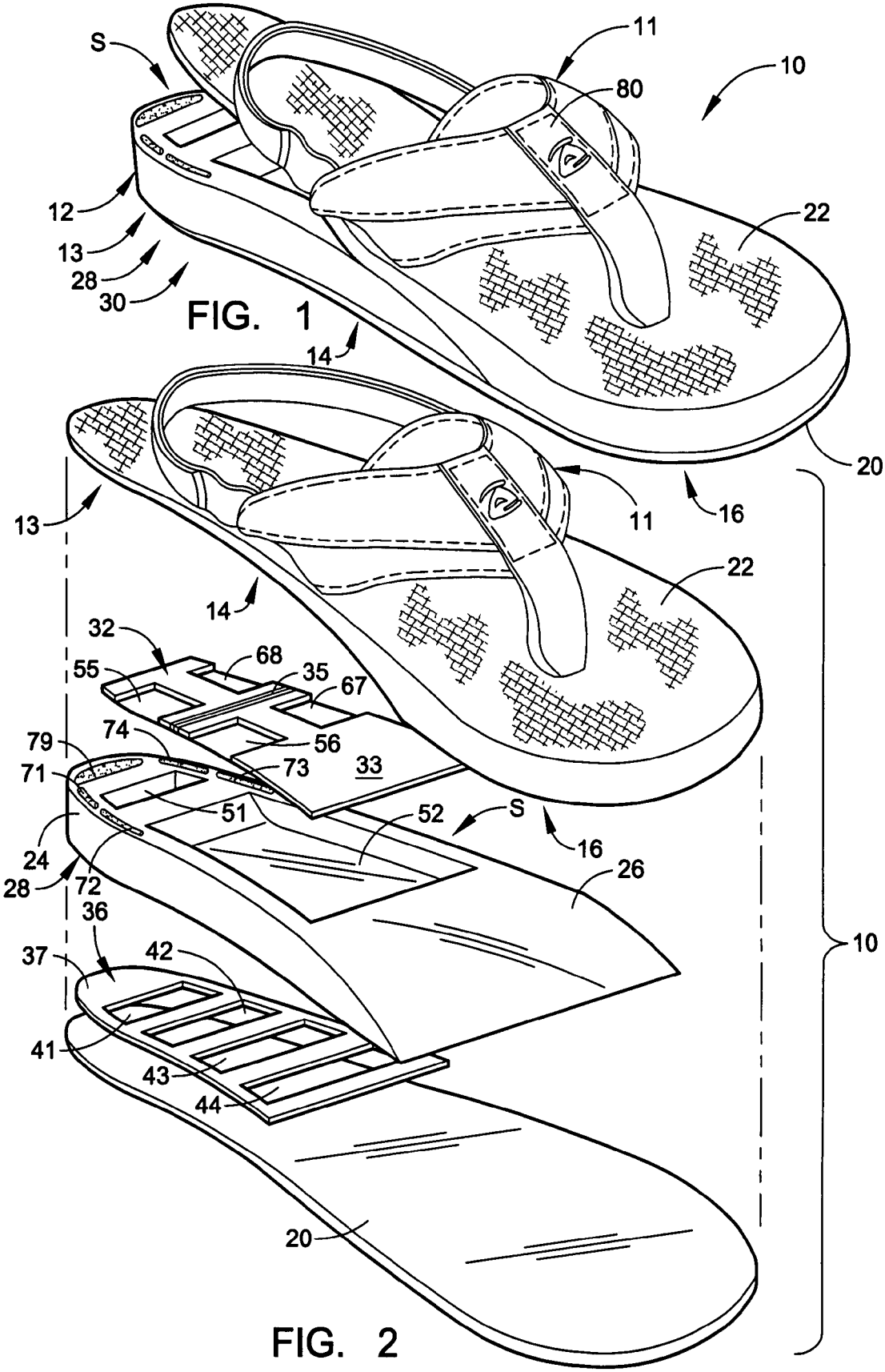
FIG. 1 is a top perspective view of a novelty footwear item, which is constructed in accordance with a preferred embodiment the present invention.
FIG. 2 is an exploded perspective view of the novelty footwear item of FIG. 1.
Figure 3:
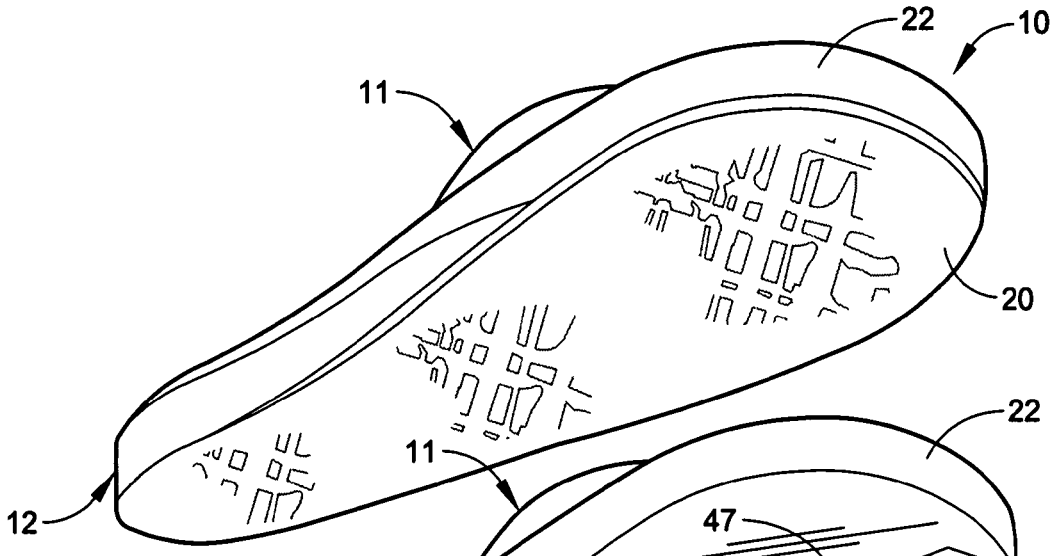
FIG. 3 is bottom perspective view of the novelty footwear item of FIG. 1 showings its midsole in a closed position.

A footwear item and method for using the footwear item to not only protect the foot of a user but to also provide the user with a footwear novelty function auxiliary to normal footwear function is disclosed. The following description is presented to enable any person skilled in the art to make and use the invention. For purposes of explanation, specific nomenclature is set forth to provide a thorough understanding of the present invention. Descriptions of specific methods and apparatus are provided only as examples. Various modifications to the preferred embodiments will be readily apparent to those skilled in the art, and the general principles defined herein may be applied to other embodiments and applications without departing from the spirit and scope of the invention. Thus, the present invention is not intended to be limited to the embodiments shown, but is to be accorded the widest scope consistent with the principles and features disclosed herein.

Referring now to the drawings and more particularly to FIGS. 1-4 there is shown an illustrative preferred embodiment of a novelty footwear item 10 which is constructed in accordance with a preferred embodiment of the present invention. The novelty footwear item 10 provides a user (not shown) with a reinforced storage space within a heel area of the footwear that will not collapse under the load of a user, although there is sufficient storage space within the heel area for carrying and concealing small personal items keys, credit cards, coins, paper money and the like. The novelty footwear item 10 when used in accordance with a novel method of using the footwear item 10, not only protects and supports the foot of the user with an attractive fashion wear appearance but also provides the user with immediate access to the concealed storage area disposed within the heel support area of the footwear item 10.

Considering now the novelty footwear item 10 in greater detail with reference to FIGS. 1-4, the novelty footwear item 10 generally comprises an upper or strap assembly 11 and a bottom or foot-shape sole assembly 12. The upper strap assembly 11 is attached to the sole assembly 12 in order to facilitate holding the foot of the user in engagement with the sole assembly 12. The upper strap assembly 11 and the foot-shape bottom 12 in combination provide an attractive fashion wear appearance. As will be explained hereinafter in greater detail, although the sole assembly 12 is constructed of flexible material and includes a large concealed storage area that could otherwise result in a footwear collapse due to user load, the novelty footwear item 10 includes a unique and novel construction which substantially prevents such load induced collapsing action.

Considering the novelty footwear item 10 in greater detail with reference to FIGS. 1-4, the foot-shape sole assembly 12 generally includes a foot-shape outsole 20, a pivotable hingeless foot-shape footbed 22, a heel member 24 and an elongated arch support member 26. The heel member 24 and arch support member 26 are integrally attached to one another to form a wedge-shape midsole 28 having a unitary construction. The midsole 28 is supported from below by the outsole 20 and extends from a heel support area of the footwear, indicated generally at 13, to an arch support area of the footwear, indicated generally at 14. For the purpose of providing the footwear 10 with a concealed storage space (S), the heel member 24 has a first storage area or space 51, while the arch support member 26 has a second storage area or space 52.

Figure 10:
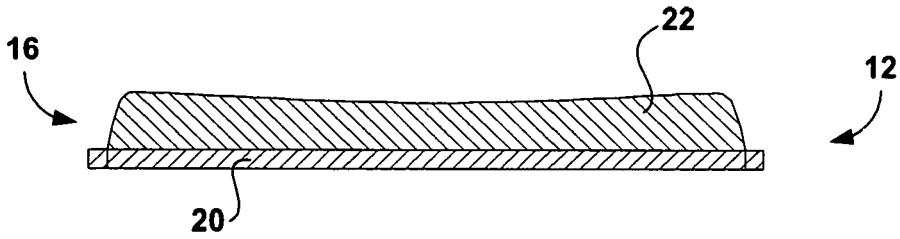
FIG. 10 is a sectional view of the footwear item of FIG. 7, taken substantially along line 10-10 thereof.
Figure 11:
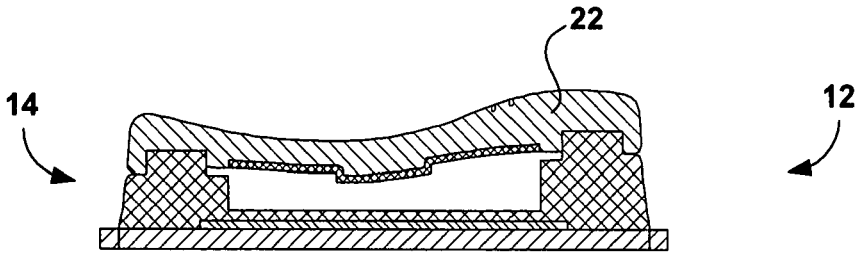
FIG. 11 is a sectional view of the footwear item of FIG. 7, taken substantially along line 11-11 thereof.
Figure 12:
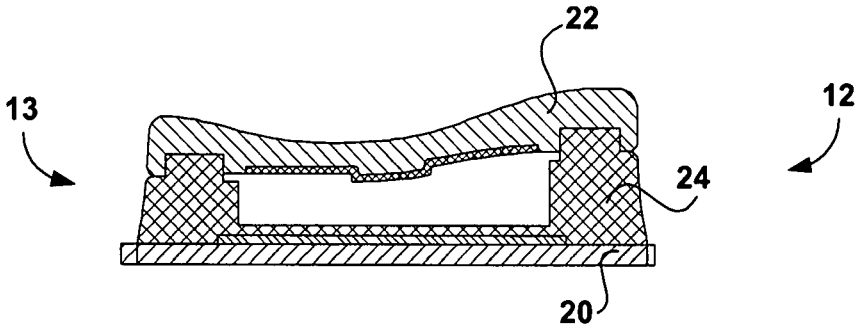
FIG. 12 is a sectional view of the footwear item of FIG. 7, taken substantially along line 12-12 thereof.
Figure 13:
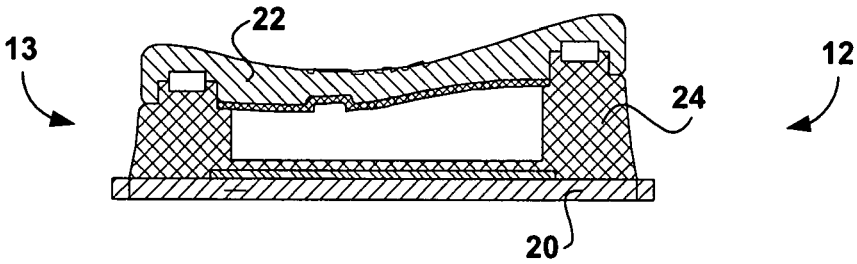
FIG. 13 is a sectional view of the footwear item of FIG. 7, taken substantially along line 13-13 thereof.
Figure 14:
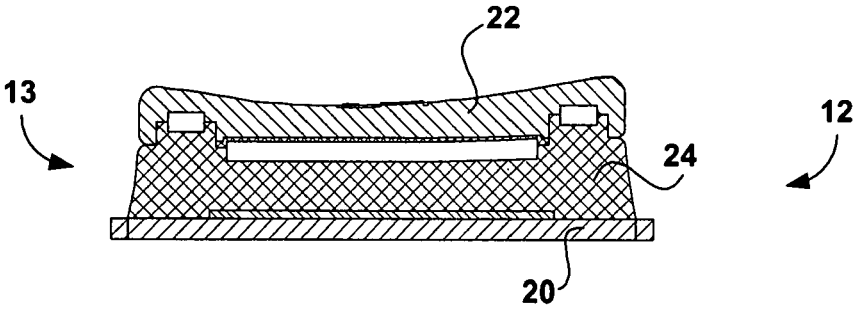
FIG. 14 is a sectional view of the footwear item of FIG. 7, taken substantially along line 14-14 thereof.

As best seen in FIG. 10, the foot-shape outsole 20 and the foot-shape footbed 22 and are fixedly attached together at about a front toe area 16 of the footwear item 10 and fixedly attached to the arch support member 26 in a sandwiching arrangement at about the arch support area 14 of the footwear item 10. The footbed 22 is further removably attached to the heel member 24 at about the heel support area 13, so that the footbed 22 may be lifted up pivotally and way from the heel member 24 to provide user access to the concealed storage space (S) disposed in the midsole 28 or more particularly, in the heel member 24 and the arch support member 26 as will be described in greater detail.

The footwear 10 further includes a collapse-flex inhibiting arrangement 30, which includes a footbed collapse-flex arrangement 30A and a midsole collapse-flex arrangement 30B disposed within the footbed 22 and the midsole 28 respectively. As will be explained hereinafter in greater detail, a plurality of empty cavity spaces 51 and 52 created within the heel member 24 and the arch support member 26 respectively have sufficient length, width and depth dimensions that could otherwise permit the flexible footbed 22 to collapse therein under the load of a user wearing the footwear 10. In a like manner, the outsole 20 could collapse into the empty cavity spaces 51, 52 from the user stepping on a stone, rock or other irregularly shaped object to cause an upwardly directed load force to be exerted toward the cavity spaces. The collapse-flex inhibiting arrangements 30 disposed within the footbed 22 and the midsole 28 substantially prevents such collapsing actions and thus, helps protect or shield the foot of the user, both in the heel support area 13 and in the arch support area 14 from discomfort due to hard objects being stored in the storage areas 51 and 52 respectively.

While the collapse-flex inhibiting arrangement 30A performs an important and critical function, the collapse-flex inhibiting arrangement 30A also performs an important secondary function. More particularly, since the footwear item 10 is constructed with a liftable footbed, the collapse-flex inhibiting arrangement 30A by its location relative to the footbed 22 helps facilitate the pivoting action of the otherwise hingeless footbed 22. In this regard, as will be explained hereinafter in greater detail, the footbed collapse-flex inhibiting arrangement 30A includes a living hinge 35 which is secured to the underside of the footbed 22. By such a close proximity location, the footbed 22 pivots at or about the location where the living hinge 35 is disposed since the footbed collapse-flex inhibiting arrangement 30A is secured to the footbed 22.

It should also be noted that footbed collapse-flex inhibiting arrangement 30A further functions to sufficiently stiffening the footbed 22 to permit it to be grasped and lifted from its end without folding or tearing under repeated lifting and closing actions. The combination of facilitating the pivoting of an otherwise hingeless flexible footbed 22 and preventing the collapse of the flexible footbed 22 into the concealed storage space (S) of the footwear 10 is an important and novel feature in the preferred embodiment of the present invention.

Considering now the novel method of using the novelty footwear item 10 in order to store and conceal small personal items within the storage area 18, a user wearing the footwear 10, first removes the footwear item 10 from his or her foot. Next, the user grapes a rear edge portion of the footbed 22 at about the heel support area 13 between his or her fingers and lifts the rear of the footbed 22 pivotally upward and away from the heel member 24. In taking this action, the interior storage space S of the storage unit is exposed as best seen in FIG. 1 so that the user may place into the storage space (S) one or more small personal items, such as coins, a key, paper money and the like. Once the user has placed the items within the storage area (S), the user lowers the rear of the footbed 22 into fastening engagement with the heel member 24 as best seen in FIG. 2.

Considering now the outsole 20 in greater detail with reference to FIGS. 1-4, the outsole 20 has a smooth upper surface that facilitates it adhesive adherence to the bottom of the midsole 28 and the bottom of the toe support area of the footbed 22. The outsole 20 is composed of a wide variety of flexible materials, such as rubber compounds, thermoplastic, thermosetting polymer compounds, foam polyurethane plastic, foam rubber and ethylene vinyl acetate. A rubber compound is a preferred material, which is sufficiently durable to function over an extended period of time as a wear surface for engaging the ground and providing the footwear 10 with the ability to grip and maintain traction with the ground.

Figure 7:
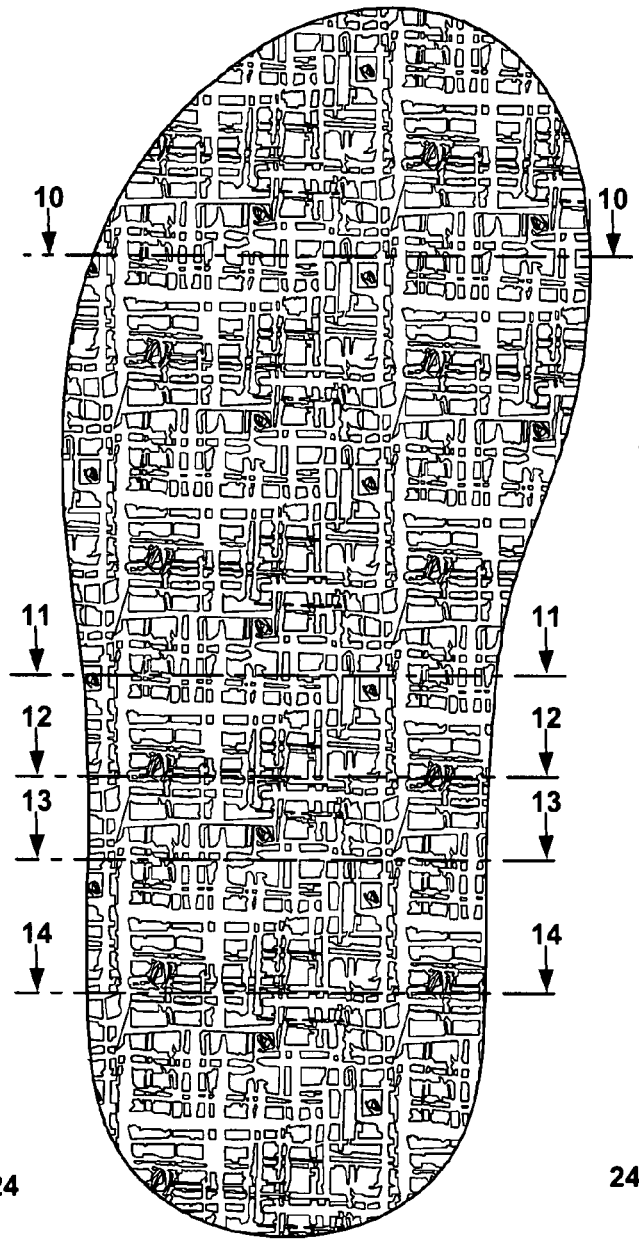
FIG. 7 is a bottom plan view of the novelty footwear item of FIG. 1.
Figure 6:
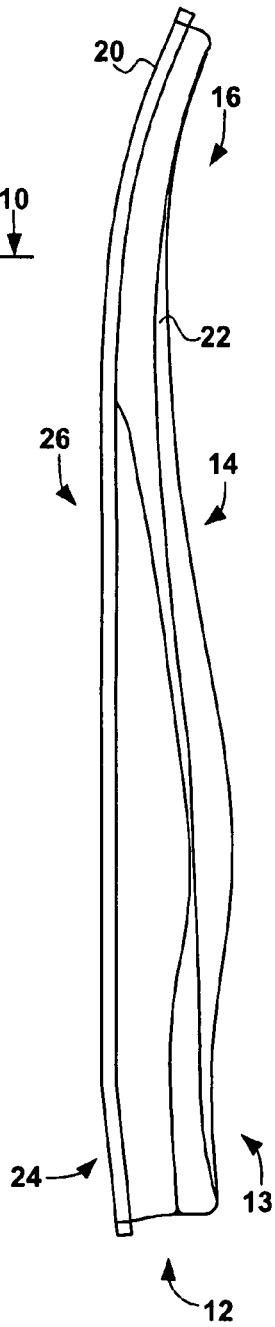
FIG. 6 is a left side elevational view of the novelty footwear item of FIG. 1.
Figure 8:
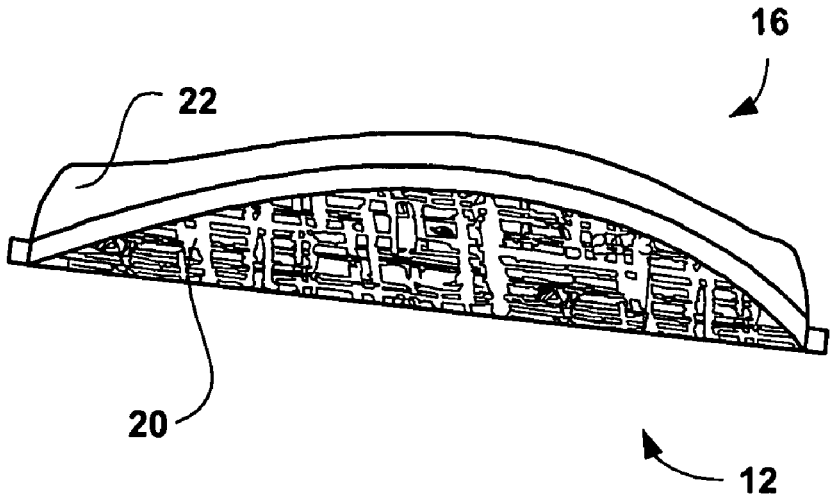
FIG. 8 is a front elevational view of the novelty footwear item of FIG. 1 with its strap assembly removed.
Figure 9:
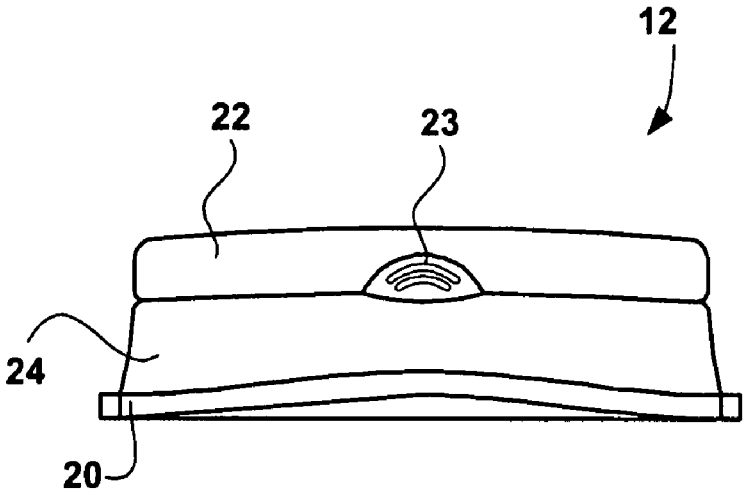
FIG. 9 is a rear elevational view of the novelty footwear item of FIG. 1, with its strap assembly removed.

Also since the bottom surface of the outer sole 20 is highly visible, the bottom surface as best seen in FIG. 7 bears a unique non-skid stylized pattern (P) which functions to prevent the footwear item 10 from slipping on the ground, to provide the footwear item 10 with traction and to provide the outer sole with an attractive appearance. As will be explained hereinafter in greater detail, the outer sole 20 also functions for facilitating transferring the dynamic energy imparted by the user to the footwear item 10 into controlled motion in a user desired and selected direction. While this is an important feature of the present invention, it should be noted that over flexing of the toe area 16 of the footwear 10 into the arch support area 14 is not desirable. In this regard, the overall wedge-like shape of the midsole 28 and more particularly, the wedge-like shape of the elongated arch support member 26 functions as a arch flex inhibiting device to substantially prevent the toe area 16 of outsole 20 from flexing beyond the distal end of the elongated arch support member 26 into the arch support area 14 of the footwear item 10.

Considering now the midsole 28 in greater detail with reference to FIGS. 1-4, the midsole 28 has as noted earlier includes the heel member 24 and the arch support member 26 that are integrally attached to one another to provide the midsole 28 with a unitary construction. The midsole has a wedge like configuration and a sufficient thickness at the heel member 24 and a portion of the arch member 28 to provide in a top surface thereof a plurality of spaced apart storage spaces, such as the storage space 51 and the storage space 52. In one preferred embodiment, the wedge shaped midsole 28 is a wedge shaped carrier member having at least two spaced apart top compartments including a writing pad compartment for receiving therein a writing pad and a writing instrument compartment for receiving therein a writing instrument such as a writing pen.

Figure 4:
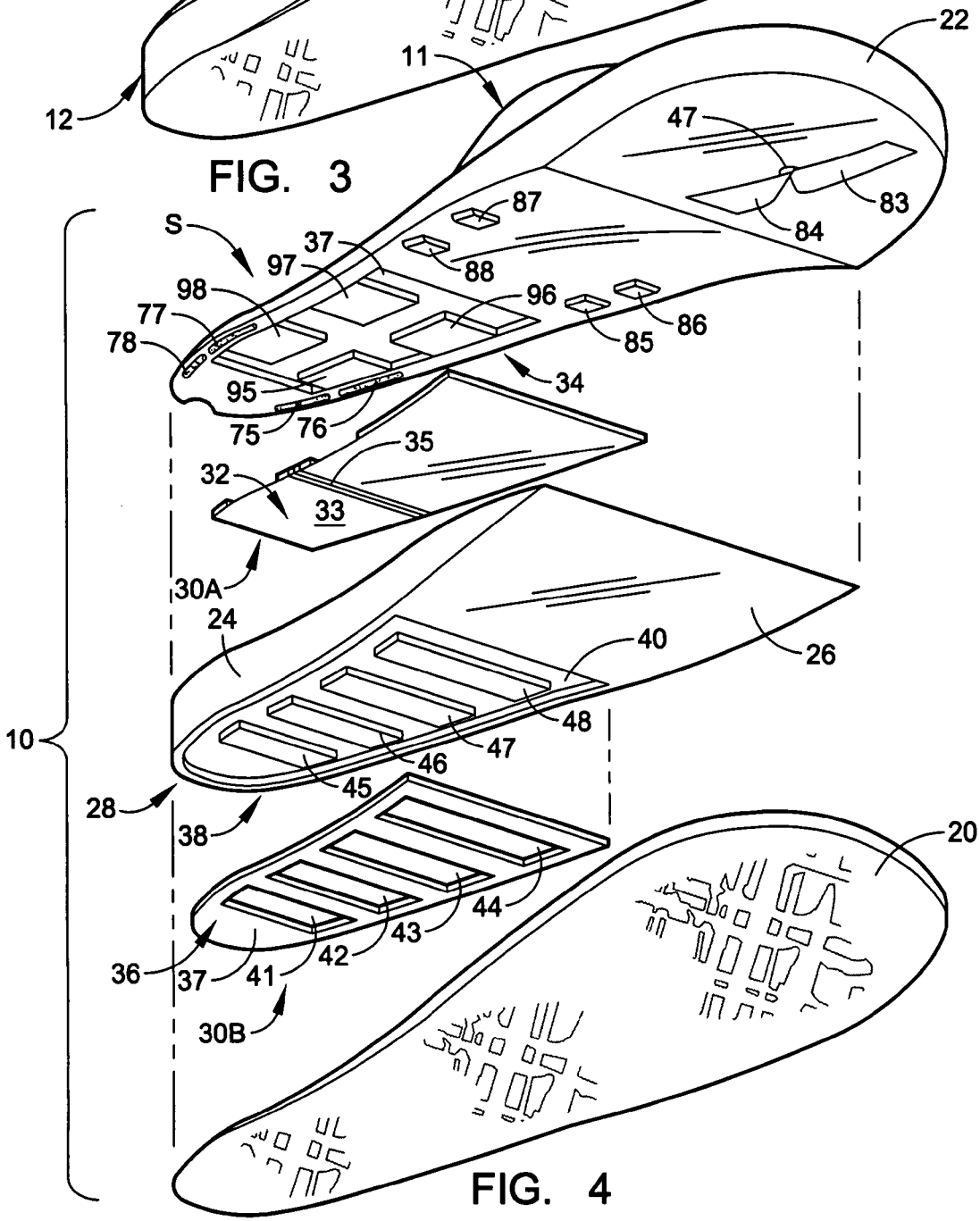
FIG. 4 is another exploded perspective view of the novelty footwear item of FIG. 2.
Figure 5:
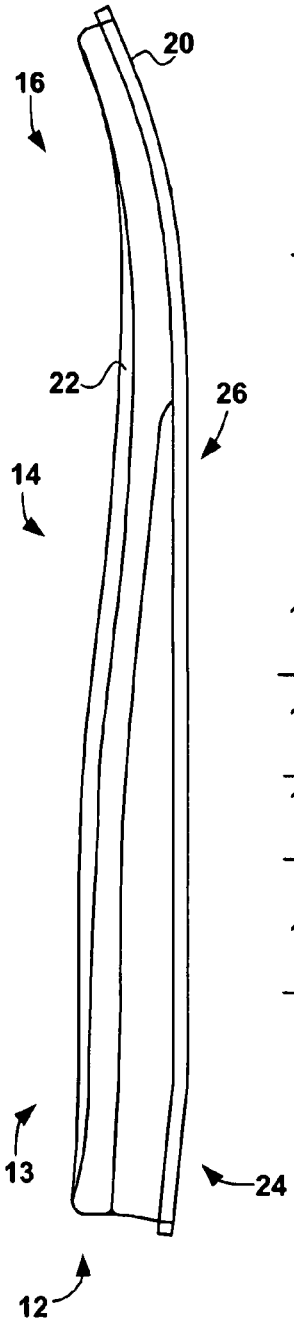
FIG. 5 is a right side elevational view of the novelty footwear item of FIG. 1.

As best seen in FIG. 4, the bottom surface of the midsole 28 has disposed therein at least one midsole bottom compartment or recessed area 40 that that has disposed therein a first stiffening arrangement 38 for helping the midsole 28 resist deformation under load. The first stiffening arrangement 38 includes a plurality of equally spaced apart elongated raised bar members, 45, 46, 47, and 48 respectively that are disposed in single straight line alignment. This recessed area with raised support bars members 45-48 is disposed substantially below the two spaced apart upper or top compartments 51 and 52 respectively.

In order to reinforce the bottom compartment bar members 45-48, a bottom compartment stiffener or midsole shank 36 corresponding in width, length and depth dimensions to the bottom compartment area of the midsole 28 is received within the bottom compartment in a friction tight fit. The bottom compartment shank 36 and stiffening arrangement 38 cooperate with one another to form the midsole collapse-flex inhibiting arrangement 30B portion of the collapse-flex inhibiting arrangement 30. The midsole bottom compartment shank 36 is composed of an appropriate stiff material such as stiff flex-board material, a stiff cardboard material, a plastic material or a metal material.

As best seen in FIGS. 2 and 4, the bottom compartment stiffener 36 has a unitary construction which includes a plurality of equally spaced apart generally rectangularly shaped apertures dimensioned to receive therein corresponding ones of the plurality of equally spaced apart elongated raised bar members 45-48 respectively. This combination arrangement of raised bars and stiffener is sufficient to help the midsole 28 resist deformation under load. Another important function of the combination midsole shank 36 and midsole stiffening arrangement 38 is to reinforce the bottom area of the midsole 28 so the outsole 20 will not collapse under load upwardly from the bottom surface area of the outsole 20 into the cavity areas 51 and 52 respectively of the midsole 28.

Considering now the footbed 22 in greater detail with reference to FIGS. 1-4, the footbed 22 as noted earlier is attached fixedly to the top surface of the elongated arch support member 26 throughout its entire longitudinal length and removably attached to the heel member 24 throughout its entire longitudinal length. The boundary between the heel member 24 and the arch support member 26 is defined by the living hinge 35 which is disposed in the underside of the footbed 22. In the regard, the living hinge 35 defines an imaginary boundary line between the heel member 24 and the arch support member 26.

As best seen in FIGS. 2 and 4, the underside or bottom area of the footbed 22 has disposed therein a footbed bottom compartment 37 which has disposed therein a second or footbed stiffening arrangement 34 for helping the heel support area 13 and arch support area 14 of the footwear item 10 from collapsing and flexing under user load into the cavity areas of the heel member 24 and arch support member 26. The footbed stiffening arrangement 34 includes a plurality of rectangularly shaped raised bar members 95, 96, 97, and 98 respectively. The raised bar members 95-98 are arranged in a generally rectangular configuration and are disposed substantially above the two storage spaces 51 and 52.

In order to reinforce the bottom compartment bar members 95-98, a bottom compartment shank, stiffener or sealing member 33 corresponding in width, length and depth dimensions to the bottom compartment area of the footbed 22 is received within the footbed bottom compartment in a friction tight fit. The bottom compartment footbed shank 36 forms part of the collapse-flex inhibiting arrangement 30 and is composed of an appropriate stiff material such as a cardboard material, a plastic material or a metal material.

As best seen in FIGS. 2 and 4, the bottom compartment shank 36 has a unitary construction which includes a thick bottom wall or sealing base member 33 with a plurality of equally spaced apart generally rectangularly shaped apertures 55, 56, 57, and 58. The apertures 55-58 are dimensioned to receive therein corresponding ones of the plurality of equally spaced apart elongated raised bar members 45-48 respectively. This combination arrangement of raised bars and stiff shank is sufficient to help the footbed 22 and midsole 28 resist deformation under load. Another important function of the combination footbed shank 32 and footbed stiffening arrangement 34 is to reinforce the bottom area of the footbed 22 so the footbed 22 will not collapse under load downwardly from the upper surface area of the footbed 22 into the cavity areas 51 and 52 respectively of the midsole 28.

In one preferred embodiment the footbed shank 32 is a solid piece of stiffing material having a heel reinforcement side and an arch support reinforcement side, where the two sides are hinged together by the living hinge 35. In this regard, since the footbed shank 32 is adhered to the bottom side of the footbed within the bottom footbed compartment 37, the living hinge 35 function as an imaginary dividing line between the heel member 24 and the arch support member 26. The living hinge 35 also enables the footbed 22 to pivot upwardly and away from the midsole 28. Although a living hinge 35 has been described as being part of the preferred embodiment of the present invention, it is contemplated that in another preferred embodiment the footbed shank could be a divided shank having a heel support area shank and an arch support area shank slightly spaced from one another to allow a footbed 22 pivoting action.

Considering now the manner in which the underside of the footbed 22 and upper surface areas of the heel member 24 and arch support member 26 are attached to one another, it can be best seen in FIGS. 2 and 4, a plurality of spaced apart and different dimensioned fasteners in the form of hook and pile clumps indicated generally at 71, 72, 73, 74, 75, 76, 77, 78, and 79 are disposed between the footbed 22 and the heel member 24 for helping to removably secure the heel area of the footbed 22 to a rear portion of the midsole 28 or more particularly to the heel member 24. An imaginary line L extending between the distal ends of the fasteners 72 and 73 defines the boundary line between the heel member 24 and the arch support member 26. As the footbed 22 and the midsole 28 are strongly fastened together by the hook and pile clumps, a finger grip cutout 23 is provided in the heel member 24 at its distal end. In this regard, a user can pinch the rear end of the footbed 22 between his or her fingers to gain a strong grip on the footbed for the purposes of lifting it upward and away from the heel member 24 of the midsole 28.

In order to permanently adhere the underside of the footbed 22 to the top surface of the arch support member 26, the footwear item 10 is provided with a bonding material that exhibits a sufficiently strong bonding characteristic to prevent separation of these two members from one another although pivoting of the footbed 22 from closed to open to closed position is repeated hundreds, if not thousands of times, at the area defined by the imaginary line L.

It should be noted that this pivot area of the footwear item 10 is disposed at about the upper compartment area 52 and provides a sufficient opening into the storage area 52 (when the footbed 22 is pivotally lifted) to allow small objects to be inserted and retrieved from the arch support area 14 of the footwear item 10. This is an important feature of the present invention since the footbed 22 is permanently affixed to the arch support member 26.

In another preferred embodiment the pivot area is disposed at the distal end of the storage compartment 52 and in yet still another preferred embodiment of the present invention the pivot area is disposed at the proximal end of the storage compartment 52.

Considering now the strap assembly 11 in greater detail with reference to FIGS. 1-4, the strap assembly 11 has a multi-strap construction which generally includes a foot or main body strap 80 having a plurality of inter-connected front anchoring straps 83-84 and a plurality of inter-connected rear anchoring straps 85-88. The front and rear anchoring straps 83-84 and 85-88 respectively, are flexible narrow fingers which extend outwardly from the main body strap 80, and are all configured to be adhesively secured to the underside of the footbed 22. The strap assembly 12 is composed of a soft pliable material, which is configured to hold the foot of the user to the bottom 14 to facilitate protecting and supporting the foot of the user.

As already described, the novelty footwear item 10 provides several unique and novel features not otherwise found in conventional footwear construction. The invention therefore, in its broader aspects is not limited to the specific details and representative embodiments shown and described herein. For example, although in the preferred embodiment sandal type footwear has been described, it is contemplated that a wedge type shoe with an upper having an attached footbed could be modified in accordance with the disclosed invention. Accordingly, various other modifications may be made without departing from the spirit and scope of the general inventive concept as defined by the appended claims and their equivalents.

We claim:

1. A novelty footwear item, comprising:

a foot-shape bottom; and an upper attached to said foot-shape bottom for holding the foot of a user in engagement with said foot-shape bottom;

wherein said foot-shape bottom includes a foot-shape outsole and a foot-shape footbed, said outsole and said footbed being sandwiched about a wedge-shape midsole having a plurality of storage compartment disposed therein;

wherein said footbed is permanently affixed to said outsole at a front toe area thereof and permanently affixed to said wedge-shape midsole at an arch support area thereof;

wherein said footbed is removably attached to said wedge-shape midsole at a heel support area thereof in order to provide a user with access to said plurality of storage compartment; and wherein at least said footbed includes a footbed collapse inhibiting arrangement to help substantially prevent said footbed from collapsing into said plurality of storage compartments under user load.

2. The novelty footwear item according to claim 1, wherein said wedge-shape midsole includes a midsole collapse inhibiting arrangement to help substantially prevent said outsole from collapsing into said plurality of storage compartment under user load.

3. The novelty footwear item according to claim 1, wherein said wedge-shape midsole has a top surface and a bottom surface, said top surface having disposed therein at least two spaced apart top compartments including a writing pad compartment for receiving therein a writing pad and a writing instrument compartment for receiving therein a writing instrument;

said bottom surface having disposed therein a midsole bottom compartment, said midsole bottom compartment including a first stiffening arrangement for helping said wedge-shape midsole resist deformation under an upwardly directed load;

said first stiffening arrangement including a plurality of equally spaced apart elongated raised bar members disposed in single straight line alignment and disposed substantially below said at least two spaced apart top compartments;

a midsole bottom compartment shank having a width dimension, a length dimension and a depth dimension corresponding to a midsole bottom compartment width dimension, a midsole bottom compartment length dimension, and a midsole bottom compartment depth dimension;

said midsole bottom compartment shank having disposed therein a plurality of equally spaced apart generally rectangularly shaped apertures dimensioned to receive therein corresponding ones of said plurality of equally spaced apart elongated raised bar members;

wherein said foot-shape footbed has a top surface and a bottom surface, said bottom footbed surface having disposed therein a footbed bottom compartment having a second stiffening arrangement disposed therein for helping said foot-shape footbed resist deformation under a downwardly directed load;

said second stiffening arrangement including a plurality of rectangularly shaped raised bar members arranged in a generally rectangular configuration and disposed substantially above said at least two spaced apart top compartments when said outsole and said footbed are sandwiched about said wedge-shape midsole; and a footbed bottom compartment shank having a width dimension, a length dimension, and a depth dimension substantially corresponding to a footbed bottom compartment width dimension, a footbed bottom compartment length dimension and a footbed bottom compartment depth dimension;

said footbed bottom compartment shank having a shank top surface and a shank bottom surface;

wherein said shank top surface has disposed therein a plurality of equally spaced apart generally rectangularly shaped cutouts arranged in a generally rectangular configuration dimensioned to receive therein corresponding ones of said plurality of rectangularly shaped raised bar members arranged in a generally rectangular configuration;

wherein said yet another bottom surface is substantially smooth throughout its entire surface area; and wherein said at least two spaced apart top compartments of said wedge-shape midsole are further sandwiched between said first stiffening arrangement and said second stiffening arrangement and corresponding ones of said bottom compartment shanks to further help said wedge-shape midsole resist deformation under differently directed loads.

4. A novelty footwear item, comprising:

a wedge-shape midsole sandwiched between an outsole and a footbed;

said midsole having an elongated storage area extending from a heel support area to an arch support area of said footbed;

collapse-flex inhibiting means partially disposed in said footbed and partially disposed in said midsole for substantially preventing outsole and footbed collapse into said elongated storage area under user load;

a footbed heel support shank disposed about said collapse-flex inhibiting means partially disposed in said footbed to reinforce a bottom area of said footbed for further substantially preventing footbed collapse into said elongated storage area under user load;

a midsole heel support shank disposed about said collapse-flex inhibiting means partially disposed is said midsole to reinforce a bottom area of said midsole for further substantially preventing outsole collapse into said elongated storage area; and wherein said footbed and at least a portion of said collapse-flex inhibiting means cooperate to facilitate the pivoting of said footbed away from said midsole to provide user access to said elongated storage area.

5. The novelty footwear item according to claim 4, wherein said wedge-shape midsole is a flexible elongated wedge-shape midsole having a heel support area and an arch support area;

said flexible elongated wedge-shape midsole having a storage compartment area disposed within said heel support area;

wherein said outsole is a flexible outsole for supporting from below said wedge-shape outsole;

wherein said footbed is fixedly attached to a front toe area of said outsole and fixedly attached to said midsole at about said arch support area; and wherein said footbed is removably attached to said midsole at said heel support area so that said footbed may be lifted up and way from said heel support area to provide user access to said storage compartment.

6. The novelty footwear item according to claim 4, wherein said elongated storage area is a writing pad storage compartment having a sufficient length dimension to extend substantially between said heel support area and said arch support area of said midsole.

7. The novelty footwear item according to claim 6, wherein said footbed has a heel support area, an arch support area and a toe support area; and wherein said midsole further includes an extended integrally attached wedge-shape arch support area for supporting from below said arch support area of said footbed.

8. The novelty footwear item according to claim 7, wherein said heel support area of said footbed corresponds in size and contour to said heel support area of said midsole, wherein said heel support area of said footbed includes a heel support shank compartment dimensioned for receiving therein said footbed heel support shank for substantially preventing said heel support area of said footbed from sinking into writing pen storage compartment under load of a user.

9. The novelty footwear item according to claim 8, wherein said heel support area of said midsole includes a heel support shank compartment dimensioned for receiving therein said midsole heel support shank for substantially preventing said heel support area of said midsole from collapsing under load of a user.

10. The novelty footwear item according to claim 4, wherein said midsole is sandwiched between said midsole heel support shank and said footbed heel support shank at about said heel support area of said midsole for substantially preventing collapse of said flexible footbed and said flexible midsole when subject to a user load.

11. The novelty footwear item according to claim 10, wherein said heel support area of said midsole has a midsole bottom compartment disposed below said pen compartment for receiving therein said midsole heel support shank.

12. The novelty footwear item according to claim 10, wherein said bottom compartment is constructed with a midsole heel support stiffening arrangement integrally disposed therein.

13. The novelty footwear item according to claim 12, wherein said midsole heel support stiffening arrangement includes a plurality of spaced apart elongated raised bar members.

14. A novelty footwear item, comprising:

a wedge-shape midsole sandwiched between an outsole and a footbed;

said midsole having an elongated storage area extending from a heel support area to an arch support area of said footbed;

collapse-flex inhibiting means partially disposed in said footbed and partially disposed in said midsole for substantially preventing outsole and footbed collapse into said elongated storage area under user load; and wherein said footbed and at least a portion of said collapse-flex inhibiting means cooperate to facilitate the pivoting of said footbed away from said midsole to provide user access to said elongated storage area;

wherein said midsole is sandwiched between a midsole shank and a footbed shank at about said heel support area of said midsole for substantially preventing collapse of said flexible footbed and said flexible midsole when subject to a user load;

wherein said bottom compartment is constructed with a midsole heel support stiffening arrangement integrally disposed therein;

wherein said midsole heel support stiffening arrangement includes a plurality of spaced apart elonaated raised bar members; and wherein said spaced apart elongated raised bar members are arranged in series in a single straight line configuration.

15. The novelty footwear item according to claim 14, wherein said midsole shank member is received within said bottom compartment in a friction tight fit, said midsole shank member including a plurality of spaced apart elongated apertures dimensioned to receive therein in a corresponding configuration individual ones of said plurality of spaced apart elongated raised bar members.

16. The novelty footwear item according to claim 15, wherein said heel support area of said footbed has a footbed bottom compartment with a footbed stiffing arrangement integrally disposed therein.

17. The novelty footwear item according to claim 16, wherein said footbed stiffening arrangement includes a plurality of spaced apart rectangularly shaped raised bar members.

18. The novelty footwear item according to claim 17, wherein said plurality of spaced apart rectangularly shaped bar members disposed in said footbed bottom compartment are arranged in a generally rectangular configuration.

19. The novelty footwear item according to claim 18, wherein said footbed shank member is received within said footbed bottom compartment in a friction tight fit, said footbed shank member including a plurality of spaced apart elongated apertures dimensioned to receive therein in a corresponding configuration individual ones of said plurality of spaced apart rectangularly shaped raised bar members.

20. The novelty footwear item according to claim 19 wherein said midsole includes an upper fastening area and said foot bed includes a lower fastening area;

wherein said upper fastening area and said lower fastening area each have disposed therein a plurality of spaced apart hook and pile clumps for helping to removably attach said midsole to said footbed at about said heel support area of said midsole; and wherein said spaced apart hook and pile clumps have different shapes and dimensions.

21. A novelty footwear item, comprising:

an outsole for engaging a ground surface;

a wedge shaped midsole having a personal object receiving compartment disposed in a top surface thereof, a bottom shank receiving compartment disposed in a bottom surface thereof, and an upper rear periphery heel area partially bounding said personal object receiving compartment;

wherein said bottom shank receiving compartment has a bottom shank disposed therein;

a footbed having a foot strap secured to a top surface thereof, a top shank receiving compartment disposed in a bottom surface thereof, and a lower rear periphery heel area partially bounding said top shank receiving compartment;

wherein said top shank receiving compartment has a top shank disposed therein;

wherein said midsole is removably attached to said footbed at about a substantial rear portion of said midsole for providing user access to said personal object receiving compartment;

wherein said midsole is sandwiched between and permanently attached to said outsole and to said footbed at about a substantial front portion of said midsole; and wherein said upper area and said lower area each have disposed therein a plurality of spaced apart and different dimensioned hook and pile clumps for helping to removably attach said midsole to said footbed about said secure a rear portion of said wedge shaped carrier member to a rear portion of said top compartment sealing member; and wherein said personal object receiving compartment is sandwiched between said top shank and said bottom shank for helping said midsole at about said object receiving compartment resist deformation under load.

* * * * *